US008651024B2

(12) United States Patent
Bowen

(10) Patent No.: US 8,651,024 B2
(45) Date of Patent: Feb. 18, 2014

(54) SHOT PACKING METHOD AND RELATED DEVICES

(76) Inventor: Mark Bowen, Ravenna, OH (US)

( * ) Notice: Subject to any disclaimer, the term of this patent is extended or adjusted under 35 U.S.C. 154(b) by 0 days.

(21) Appl. No.: 13/602,121

(22) Filed: Sep. 1, 2012

(65) Prior Publication Data

US 2012/0325104 A1 Dec. 27, 2012

(51) Int. Cl.
*F42B 7/04* (2006.01)

(52) U.S. Cl.
USPC ..... 102/460; 102/457

(58) Field of Classification Search
USPC ..... 102/448, 449, 454, 457, 460
See application file for complete search history.

(56) References Cited

U.S. PATENT DOCUMENTS

| | | | | |
|---|---|---|---|---|
| 41,590 | A | | 2/1864 | Allen |
| 111,377 | A | | 1/1871 | Paine |
| 487,028 | A | | 11/1892 | Ginalsky |
| 875,762 | A | | 1/1908 | Winans et al. |
| 1,277,810 | A | | 9/1918 | Woodhouse |
| 1,575,716 | A | | 5/1925 | Pavek |
| 1,583,559 | A | | 11/1925 | Kenneweg |
| 1,883,575 | A | | 6/1929 | Clyne |
| 1,917,118 | A | | 7/1932 | Hislop |
| 3,074,344 | A | | 1/1963 | Devaux |
| 3,131,634 | A | | 5/1964 | Freed |
| 3,195,461 | A | * | 7/1965 | Freed ..... 102/457 |
| 3,402,664 | A | | 9/1968 | Cramer |
| 3,598,057 | A | | 8/1971 | Potter |
| 3,796,157 | A | | 3/1974 | Anderson |
| 3,877,381 | A | | 4/1975 | McCoy |
| 3,952,659 | A | | 4/1976 | Sistino |
| 3,996,865 | A | | 12/1976 | Dwyer |
| 4,679,505 | A | * | 7/1987 | Reed ..... 102/449 |
| 4,686,904 | A | | 8/1987 | Stafford |
| 4,718,348 | A | | 1/1988 | Ferrigno |
| 4,760,793 | A | | 8/1988 | Herring |
| 4,815,388 | A | * | 3/1989 | Schluckebier et al. ..... 102/449 |
| 4,913,054 | A | * | 4/1990 | Petersen ..... 102/439 |
| 6,202,561 | B1 | | 3/2001 | Head et al. |
| 7,765,933 | B2 | | 8/2010 | Poore et al. |
| 8,171,849 | B2 | | 5/2012 | Amick |
| 2008/0141892 | A1 | | 6/2008 | Kempf |
| 2010/0294158 | A1 | | 11/2010 | Poore et al. |
| 2011/0185936 | A1 | | 8/2011 | Richardson et al. |

* cited by examiner

*Primary Examiner* — James Bergin
(74) *Attorney, Agent, or Firm* — Dominic Frisina

(57) ABSTRACT

A cartridge ammunition load and/or method. Such a load may comprise a shot casing, a combustible propellant charge, a wad, and a plurality of shot. The shot may include shot of a first size and a second size, wherein the second size is within 80-95% of the first size. The first-size shot may be arranged in a stack of one or more planar rings, and may have the second-size shot disposed in a central interstice of one or more of the rings. Embodiments may include any number of layers of shot of the first and second size, and the second-size shot need not be present between every pair of adjacent layers of first-size shot.

20 Claims, 6 Drawing Sheets

SHOT PACKING METHOD AND RELATED DEVICES

I. BACKGROUND OF THE INVENTION

A. Field of Invention

Some embodiments may generally relate to cartridge ammunition and/or related devices and methods.

B. Description of the Related Art

Cartridge ammunition, including shotgun ammunition, is known in the art. Various shot packing methodologies and configurations have been developed over the years to improve performance characteristics such as packing density, penetration, and shot pattern. For instance, it is known to use small diameter shot to increase packing density; however, this type of shot has very low penetration and is not suitable for large game or for self-defense. One way in which the packing density of larger shot has been improved in the past is to use non-spherical shot geometries. For instance, it is known to use circular cylinders, hexagonal cylinders, and nested conical shot. Another way in which attempts have been made at improving the packing density of larger shot is to stack a single column of larger spherical shot and pack the lateral interstices with much smaller spherical shot; however, this causes non-uniform penetration. This is particularly undesirable because loads are typically selected with a desired degree of penetration in mind. Therefore, ammunition having components with widely different degrees of penetration are likely to cause undesirable over or under penetration of the target. Thus, the approach to creating high-density loads of larger shot has been to use non-spherical shot or a combination of spherical shots having very large differences in diameter. What is missing and needed in the art is a high-density spherical-shot load with a more uniform shot size.

Some embodiments of the present invention may provide one or more benefits or advantages over the prior art.

II. SUMMARY OF THE INVENTION

Some embodiments may relate to an improved cartridge ammunition load, comprising: a shot casing having a first end adapted to be retained in a breach and a second end adapted to face a muzzle; a combustible propellant charge disposed at the first end of the shot casing and defining a layer; a wad disposed in the shot casing and defining a barrier between the first end and the second end of the shot casing; and a plurality of shot contained within the second end of the shot casing and retained therein, the shot comprising: five of a first shot having a first size, each of the first shots having centers of mass lying on a common plane and defining a pentagonal ring, wherein the five first shots collectively define a central interstice; and a second shot having a second size which is less than that of the first shots and having a center of mass axially aligned with a collective center of mass of the pentagonal ring of first shots.

According to some embodiments the first shots and second shot are individually selected from one or more of spherical shot, ellipsoidal shot, cylindrical shot, regular cuboidal shot, irregular cuboidal shot, regular octahedral shot, irregular octahedral shot, regular dodecahedral shot, irregular dodecahedral shot, regular polyhedral shot, irregular polyhedral shot, or any combination thereof.

According to some embodiments the second shot defines a generally spherical shape having a diameter, as a percentage of the diameter of the first shot, from about 80% to 81%, 81% to 82%, 82% to 83%, 83% to 84%, 84% to 85%, 85% to 86%, 86% to 87%, 87% to 88%, 88% to 89%, 89% to 90%, 90% to 91%, 91% to 92%, 92% to 93%, 93% to 94%, 94% to 95% or any combination thereof.

According to some embodiments each of the first shots and each of the second shots individually comprise a material selected from one or more of lead, iron, nickel, cobalt, steel, copper, bismuth, plated shot, tungsten, thorium, depleted uranium, hardened shot, rubber, rubber-coated metal, or any alloy or combination thereof.

According to some embodiments the second shot comprises a material having a density as a percentage of that of the first shot which is from about 0 percent to 250 percent different from that of the first shot.

According to some embodiments each of the first shots contacts two of the other first shots having centers of mass lying on a common plane.

According to some embodiments a plurality of the first shot is arranged in a plurality of groups of five, wherein all shots in each group of five shots have centers of mass lying on a common plane and defining a pentagonal ring, and wherein each plane containing a pentagonal ring of five shots is oriented generally parallel to other planes containing five shots.

According to some embodiments a second shot is interposed between one or more of the plurality of pentagonal rings of first shot and axially aligned with the collective centers of mass of each of the pentagonal rings of first shot.

According to some embodiments a second shot is interposed between each of the plurality of pentagonal rings of first shot and axially aligned with the collective centers of mass of each of the pentagonal rings of first shot.

According to some embodiments each of the plurality of parallel pentagonal rings of first shot are in a staggered orientation relative to the closest parallel pentagonal ring of first shot.

According to some embodiments each of the plurality of parallel pentagonal rings of first shot contact the closest parallel ring of first shot.

According to some embodiments a second shot is interposed between one or more of the plurality of pentagonal rings of first shot and axially aligned with the collective centers of mass of each of the pentagonal rings of first shot, and wherein each second shot contacts less than all of the immediately surrounding first shot.

According to some embodiments a second shot is interposed between one or more of the plurality of pentagonal rings of first shot and axially aligned with the collective centers of mass of each of the pentagonal rings of first shot, and wherein each second shot contacts all of the immediately surrounding first shot.

Some embodiments may relate to an improved cartridge ammunition load, comprising: a shot casing having a first end adapted to be retained in a breach and a second end adapted to face a muzzle; a combustible propellant charge disposed at the first end of the shot casing and defining a layer; a wad disposed in the shot casing and defining a barrier between the first end and the second end of the shot casing; and a plurality of shot contained within the second end of the shot casing and retained therein, the shot comprising: a plurality of groups of five of a first shot, each of the first shot having a first size, and each group of five of the first shot having centers of mass lying on a common plane, and each group of five of the first shot defining a pentagonal ring, wherein each of the pentagonal rings are oriented generally parallel to the other pentagonal rings, and wherein each pentagonal ring defines a central interstice; and a second shot having a second size which is less than that of the first shots and having a center of mass axially aligned with a collective center of mass of each of the pentagonal rings of first shots and disposed within the central interstices of the pentagonal rings of first shot.

According to some embodiments the second shot defines a generally spherical shape having a diameter, as a percentage of the diameter of the first shot, from about 80% to 81%, 81% to 82%, 82% to 83%, 83% to 84%, 84% to 85%, 85% to 86%, 86% to 87%, 87% to 88%, 88% to 89%, 89% to 90%, 90% to 91%, 91% to 92%, 92% to 93%, 93% to 94%, 94% to 95% or any combination thereof.

According to some embodiments each of the first shots contacts two of the other first shots having centers of mass lying on a common plane.

According to some embodiments each of the plurality of parallel pentagonal rings of first shot are in a staggered orientation relative to the closest parallel pentagonal ring of first shot.

According to some embodiments each of the plurality of parallel pentagonal rings of first shot contact the closest parallel ring of first shot.

According to some embodiments each second shot contacts less than all of the immediately surrounding first shot.

Some embodiments relate to an improved cartridge ammunition load, comprising: a shot casing having a first end adapted to be retained in a breach and a second end adapted to face a muzzle; a combustible propellant charge disposed at the first end of the shot casing and defining a layer; a wad disposed in the shot casing and defining a barrier between the first end and the second end of the shot casing; and a plurality of shot contained within the second end of the shot casing and retained therein, the shot comprising: a plurality of groups of five of a first shot, each of the first shot having a first size, and each group of five of the first shot having centers of mass lying on a common plane, and each group of five of the first shot defining a pentagonal ring, wherein each of the pentagonal rings are oriented generally parallel to the other pentagonal rings, wherein each pentagonal ring defines a central interstice, wherein each of the first shots contacts two of the other first shots having centers of mass lying on a common plane, wherein each of the plurality of parallel pentagonal rings of first shot are in a staggered orientation relative to the closest parallel pentagonal ring of first shot, and wherein each of the plurality of parallel pentagonal rings of first shot contact the closest parallel ring of first shot; and a second shot having a second size which is less than that of the first shots and having a center of mass axially aligned with a collective center of mass of each of the pentagonal rings of first shots and disposed within the central interstices of the pentagonal rings of first shot, wherein the second shot defines a generally spherical shape having a diameter, as a percentage of the diameter of the first shot, from about 80% to 81%, 81% to 82%, 82% to 83%, 83% to 84%, 84% to 85%, 85% to 86%, 86% to 87%, 87% to 88%, 88% to 89%, 89% to 90%, 90% to 91%, 91% to 92%, 92% to 93%, 93% to 94%, 94% to 95% or any combination thereof, and wherein each second shot contacts less than all of the immediately surrounding first shot.

Other benefits and advantages will become apparent to those skilled in the art to which it pertains upon reading and understanding of the following detailed specification.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

IV. DETAILED DESCRIPTION OF THE INVENTION

Figure 2:
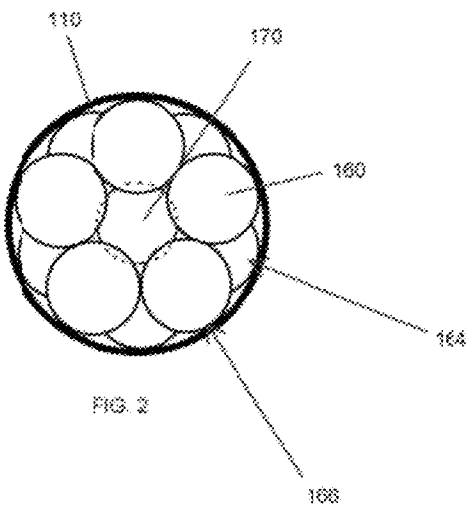
FIG. 2 is a cross sectional view of the ammunition cartridge of FIG. 1 taken along line 2-2.

Some embodiments may relate to an improved shot packing configuration and/or method for loading cartridge ammunition such as shotgun ammunition. For instance, embodiments can include a shot packing configuration in which a plurality of a first spherical shot forms a first layer arranged in a ring and defines a central interstice. A second shot may form a second layer comprising a single shot disposed in the central interstice defined by the preceding layer. Additional layers of shot may be added in a more or less alternating fashion; however, it is permissible to have unfilled central interstices, i.e. to omit the second shot in one or more layers. Some of the embodiments set forth herein may enable the loading of 1, 1.5, and/or 2 buckshot at an optimal space-filling efficiency in 10 and/or 12 gauge shells and produce muzzle velocities that are suitable for most applications, i.e. from about 1100 to about 1350 fps. Such an arrangement may also produce an improved or optimal penetration for self defense and/or some hunting applications.

According to some embodiments, adjacent layers of the first shot may be arranged in a staggered configuration relative to each other. Thus, shot packing density is increased because the ring layers are disposed in the interstices of their nearest neighboring ring layer(s). Alternatively, some embodiments may be aligned so that the centers of mass of each ring member align with a corresponding shot in an adjacent ring member. Still further, embodiments can include ring layers which are spaced sufficiently far apart so that they are able to freely rotate relative to adjacent ring layers; however, both such alternative arrangements would significantly decrease the packing density.

Shot ring sizes can be from four to six members. Table 1 shows the effect the number of shots in a layer on packing density. The highest density is that of a single shot which occupies 66.7% of the volume of the cartridge as compared to a cylinder filling 100%. However, if more than one shot is present the packing density of spherical shot decreases dramatically. For instance, the percent volume occupied by two spherical shots converges to 47.1% at an infinite number of layers. Decreasing the shot size and increasing the number of shots per layer generally increases the percent volume occupied; however, something unexpected happens when a layer has five shots. Specifically, the packing density of a five membered ring is actually greater than that of a six membered ring in a 5+1 versus 6+1 arrangement. That is, where a five membered ring includes a slightly smaller shot in its central interstice as compared to a six membered ring with a same-size shot in its central interstice.

TABLE 1

Spherical Shot Stacking Density-Percent of Cylinder Vol. Occupied.

| # of layers | # of shot per layer | | | | | | |
|---|---|---|---|---|---|---|---|
| | 2 | 3 | 5 | 4 | 6 + 1 | 5 + 1 | 1 |
| 1 | 33.3 | 43.1 | 45.7 | 45.8 | 51.9 | 45.7 | 66.7 |
| 2 | 39.1 | 47.4 | 49.4 | 49.7 | 51.9 | 53.0 | 66.7 |
| 3 | 41.4 | 49.1 | 50.7 | 51.2 | 54.6 | 55.4 | 66.7 |
| 4 | 42.7 | 50.0 | 51.4 | 52.0 | 56.1 | 56.7 | 66.7 |
| 5 | 43.5 | 50.5 | 51.9 | 52.4 | 56.9 | 57.4 | 66.7 |
| 6 | 44.1 | 50.9 | 52.2 | 52.7 | 57.5 | 57.9 | 66.7 |
| 7 | | | | | 58.0 | 58.2 | 66.7 |
| 8 | | | | | 57.2 | 58.5 | 66.7 |
| ∞ | 47.1 | 52.8 | 53.7 | 54.4 | 59.4 | 60.7 | 66.7 |

Embodiments may include a first shot comprising any of a wide variety of known materials that are suitable for use in ammunition. For instance, embodiments can include first shot comprising one or more of lead, iron, nickel, cobalt, steel, copper, bismuth, plated shot, tungsten, thorium, depleted uranium, hardened shot, rubber, rubber-coated metal, or alloy or any combination thereof. One skilled in the art will appreciate that the particular material selected will depend on the desired performance characteristics; for instance and without limitation, one may select rubber or rubber coated shot to produce a non-lethal load.

Embodiments may further include a second shot comprising one or more of lead, iron, nickel, cobalt, steel, copper, bismuth, plated shot, tungsten, thorium, depleted uranium, hardened shot, rubber, rubber-coated metal, or alloy or any combination thereof. Second shot may comprise materials that are harder than that of the surrounding first shot because the second shot does not ordinarily contact the gun barrel. Thus, harder materials can be used for the second shot without scoring the barrel. However, if a shot cup is used then any material can be loaded as the first or second shot without scoring the barrel.

In some embodiments it may be desirable to adjust the density of the second shot, i.e. the center ball, to adjust the degree of penetration. For instance, it may be desirable to match the degree of penetration of the first and second shot, or it may be desirable to have an over-penetrating second shot. One way in which density adjustment might be accomplished would be to make the second shot from a similar alloy as that of the first but adding a larger amount of a relatively dense element. This could be done by alloying the denser metal with a less dense matrix metal, by dispersing crystals of a denser metal in a matrix metal, or by sintering a mixture of metals from a powder. In this way, density becomes more or less tunable and a particular density can be selected. One skilled in the art will appreciate that other means for adjusting the density of metal alloys and mixtures are known and may be appropriate depending on the specific application.

Figure 1:
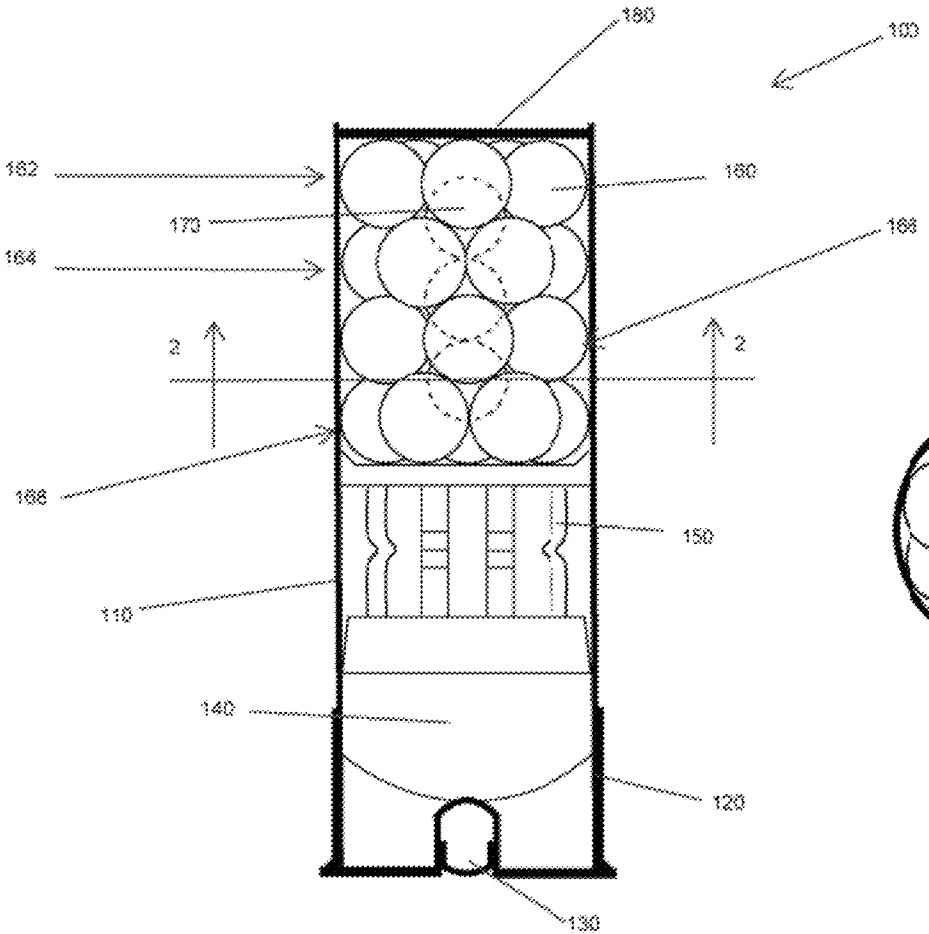
FIG. 1 is a cross sectional side view of an ammunition cartridge according to one embodiment.

Referring now to the drawings wherein the showings are for purposes of illustrating embodiments of the invention only and not for purposes of limiting the same, FIG. 1 is a side cross sectional view of a shot cartridge 100 according to one embodiment. The cartridge 100 includes a shell 110 typically comprised of polymer, and a metal base 120 which retains a primer charge 130. The cartridge 100 further comprises a combustible propellant charge 140 such as cordite or other smokeless powder charges. The propellant charge 140 is retained within the shell 110 with a wad 150 which separates it from the shot 160, 170. The shell 110 is sealed with a closure 180 which is typically formed by crimping the end of the shell 110. According to embodiments of the invention, a first shot 160 is slightly larger than a second shot 170. For instance, the second shot 170 may be from about 80 to 95% the diameter of the first shot. More particularly, the second shot may be from about 80% to 81%, 81% to 82%, 82% to 83%, 83% to 84%, 84% to 85%, 85% to 86%, 86% to 87%, 87% to 88%, 88% to 89%, 89% to 90%, 90% to 91%, 91% to 92%, 92% to 93%, 93% to 94%, 94% to 95% or any combination thereof. Here as elsewhere in the specification and claims, ranges may be combined.

With continuing reference to FIG. 1, the embodiment set forth therein includes a plurality of layers of first shot 162, 164, 166, 168. Each layer 162, 164, 166, 168 comprises five first shot wherein each shot of the respective layers has a center of mass lying on a common plane. As shown in FIG. 2, each layer of first shot 162, 164, 166, 168 is arranged in a pentagonal ring where each member of the ring is in contact with two other members of the same ring and defines a central interstice. With further regard to FIG. 2, a second shot 170 can be seen occupying the central interstice. The view of FIG. 2 is from under layer 166 looking upward; therefore, the next layer of first shot is layer 164 which is oriented in a staggered configuration relative to layer 166. The layers of first shot 162, 164, 166, 168 will spontaneously assume this configuration as it is a lowest-energy arrangement. The staggered configuration is also a closest-pack arrangement because each layer rests in the interstices of the adjacent layer(s) of first shot.

Figure 3:
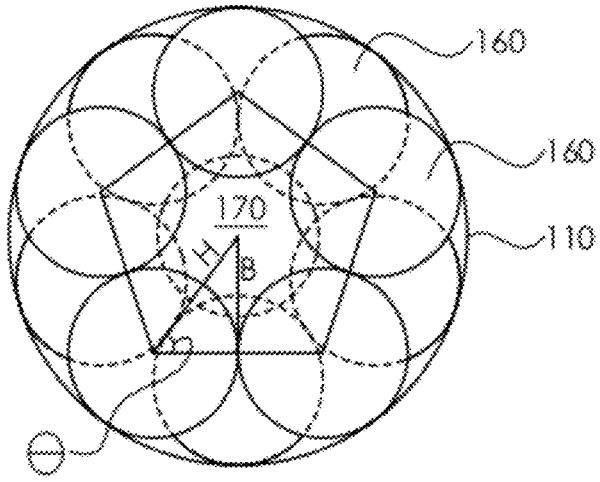
FIG. 3 is a top view of a shell loaded with a 5+1 embodiment.

With reference to FIG. 3, a pentagonal ring embodiment is shown. For the sake of explanation, it is assumed that the diameter of first shot 160 is two arbitrary units. Line H is the distance from the center of a first shot 160 to the center of the shot shell 110. Line B is perpendicular to a side of the pentagon defined by the ring of first shot 160 which extends to the center point of the shot shell 110. Accordingly, angle $\theta$ is 54 degrees therefore the length of line H is $1/\cos\theta$, i.e. 1.7013 arbitrary units, and since the radius of the first shot 160 is 1, we know that the diameter of the shot shell is 5.4026 arbitrary units.

Figure 4:
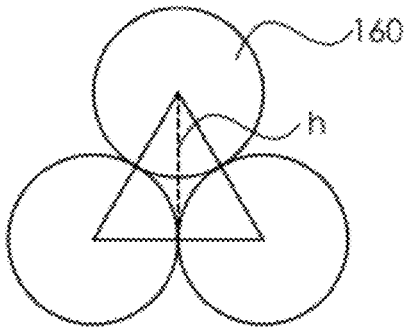
FIG. 4 is a side view of three first shots in two vertically stacked rings.

Turning to FIG. 4, we can calculate the vertical distance between the centers of abutting first shot 160 located in adjacent rings where the rings are in a staggered relation to each other. The centers of the three first shots 160 shown in FIG. 4 form an equilateral triangle having a height h. Since we know that each side of the triangle is two arbitrary units, we can calculate the height h to be the square root of three, i.e. 1.732. However, in three dimensions the center of the top ball in this drawing does not sit perfectly vertical over the underlying two shot balls but rather is offset slightly by 0.3249 arbitrary units (H-B). Therefore, the actual vertical distance between the centers of the shot balls in FIG. 4 is 1.7013 arbitrary units according to the Pythagorean Theorem.

Figure 5:
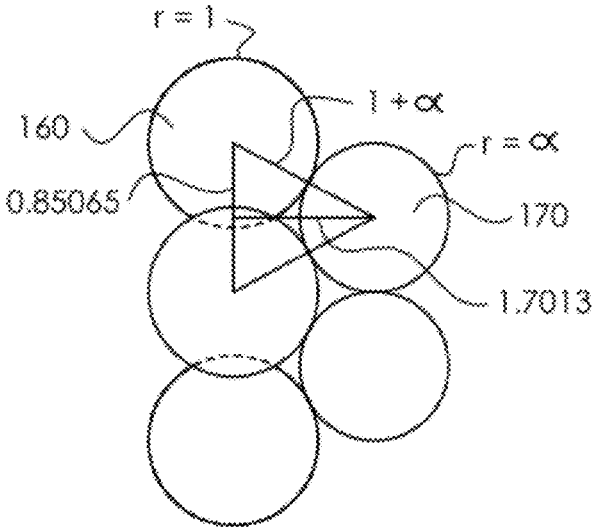
FIG. 5 is a side view of a 5+1 embodiment showing how alpha is determined.

From the foregoing relationships we can calculate the ideal size of a second shot 170, i.e. center ball in the simple case where we have two pentagonal rings of first shot 160 in a staggered stacking relation to each other with a single second shot 170 in the central interstice between the two layers. According to FIG. 5, we can see that the distance from the center of a first shot 160 to a second shot 170 with which it is in contact is $1+\alpha$, where $\alpha$ is the unknown radius of the second shot 170. Since we know the vertical height between stacked first shot 160, i.e. 1.7013 arbitrary units, and we know the value of H and the radius of the first shot 160 we can solve for the radius α of the second shot 170 using the Pythagorean Theorem to obtain α=0.90211 arbitrary units. Thus the ideal size of a second shot 170 in this case is 90.211% that of the first shot 160.

As we add additional layers of first shot 160 and additional second shots 170, the calculation of ideal size changes slightly to the following equation: $H^2+[0.5Nv-(N-1)\alpha]^2=(1+\alpha)^2$ where H remains constant at 1.7013, N is the number of layers of second shot 170 and v remains constant at 1.7013. When N equals two, solving the quadratic equation for α yields α=0.88640 arbitrary units. This same equation can be repeated for successive layers, and the alphas obtained are summarized in Table 2. As you can see, a converges at 0.85065 as the number of layers approaches infinity.

TABLE 2

| Layers | Center Shot | α | Total Shot |
|---|---|---|---|
| 1 | 0 | n/a | 5 |
| 2 | 1 | 0.90211 | 11 |
| 3 | 2 | 0.88640 | 17 |
| 4 | 3 | 0.87816 | 23 |
| 5 | 4 | 0.87304 | 29 |
| 6 | 5 | 0.86954 | 35 |
| 7 | 6 | 0.86700 | 41 |
| ∞ | | 0.85065 | ∞ |

Figure 6A:
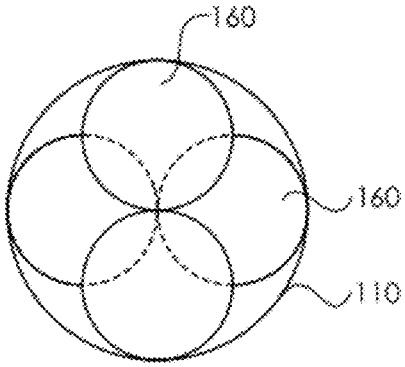
FIG. 6A is a top view of a 2-ball loading pattern.
Figure 6B:
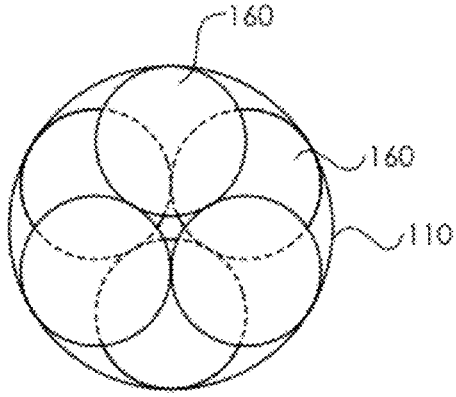
FIG. 6B is a top view of a 3-ball loading pattern.
Figure 6C:
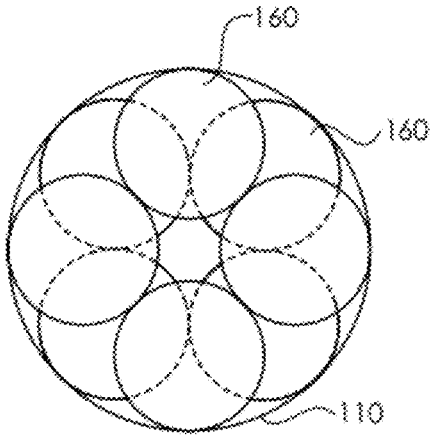
FIG. 6C is a top view of a 4-ball loading pattern.
Figure 6D:
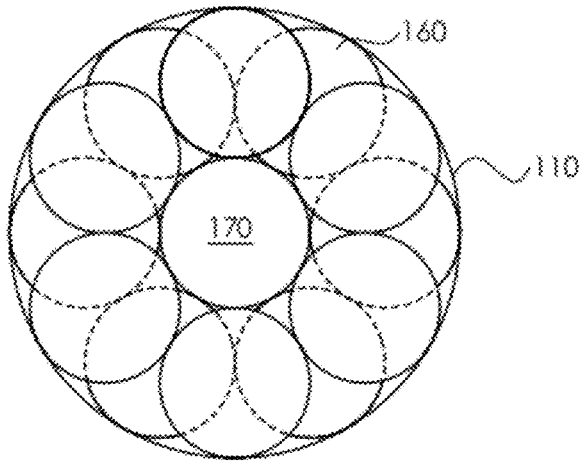
FIG. 6D is a top view of a 6-ball loading pattern.

Turning to FIGS. 6A through 6D, we see top views of four alternative shot packing arrangements including two shots per layer 6A. FIG. 6B shows three shots per layer, and FIG. 6C shows four shots per layer. In all of these cases, the central interstice is so small that adding a second shot in this space would produce a shot having significantly decreased penetration. FIG. 6D shows a six per layer stacking pattern with a second shot in the central interstice. Table 1 summarizes the space filling efficiency of each of these loads as well as that of a pentagonal stacking arrangement according to two different embodiments of the invention where the "5" load indicates the pentagonal loading arrangement with no second shot 170, i.e. no center ball, and the load designated "5+1" indicates load where the size of the second shot 170 is slightly less than that of the first shot 160 according to embodiments of the invention.

Figures 1, 7A:
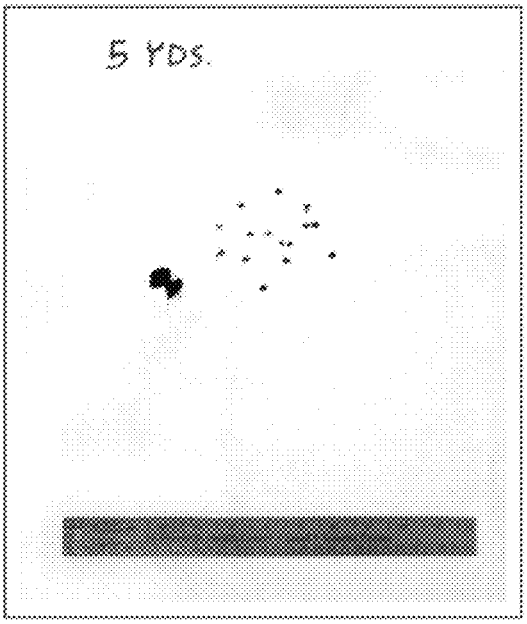
FIG. 7A is a set of two photographs of shot patterns resulting from an embodiment fired from 5 yards.
Figures 2, 7A:
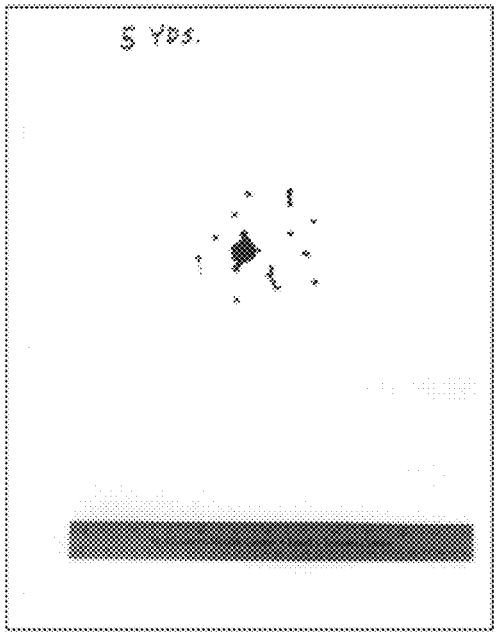
Figures 1, 7B:
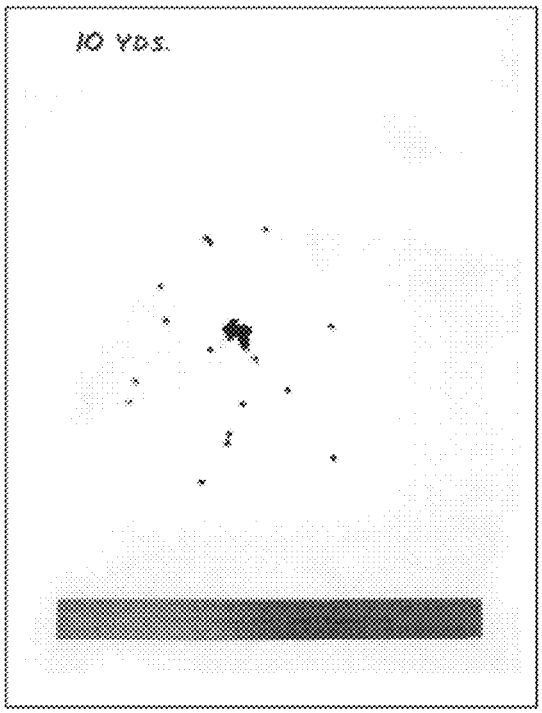
FIG. 7B is a set of two photographs of shot patterns resulting from an embodiment fired from 10 yards.
Figures 2, 7B:
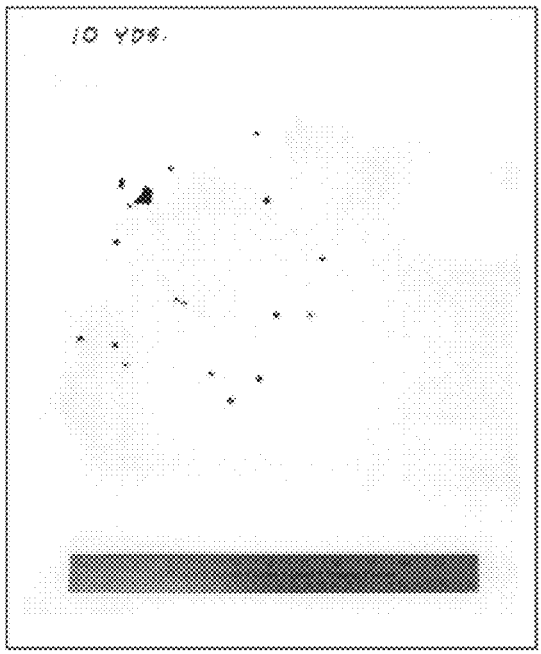
Figures 1, 7C:
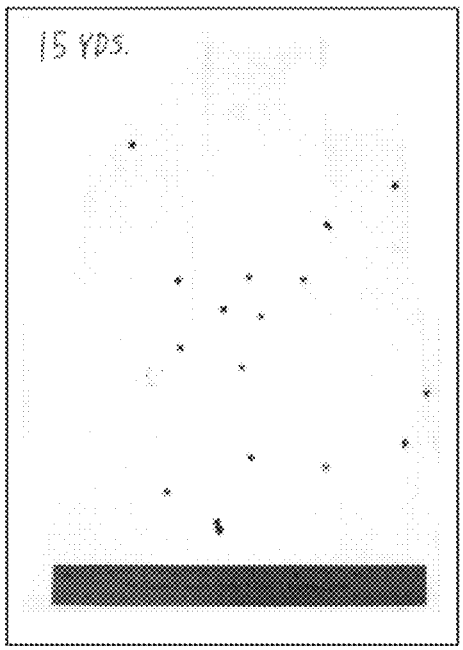
FIG. 7C is a set of three photographs of shot patterns resulting from an embodiment fired from 15 yards.
Figures 2, 7C:
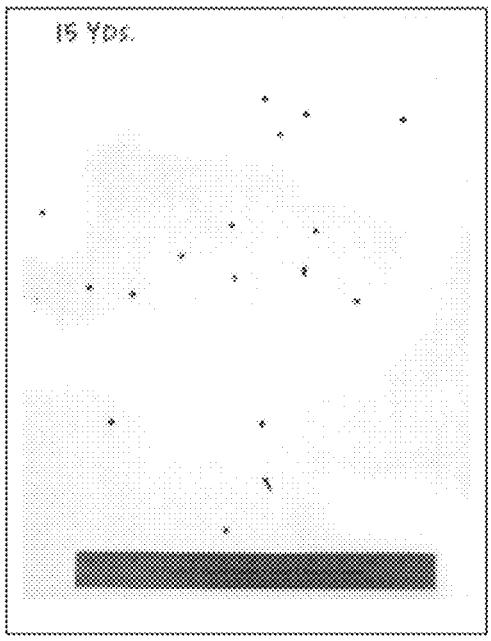
Figures 3, 7C:
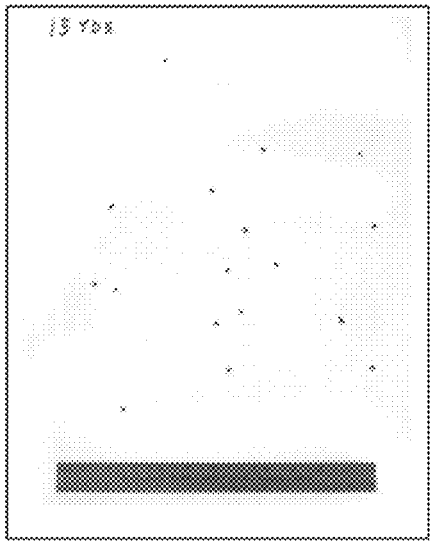

FIGS. 7A-C show the shot pattern performance of a 5+1 embodiment at 5 yards, 10 yards, and 15 yards. FIGS. 7A and 7B show two different shot patterns each, while FIG. 7C shows three different shot patterns. Such a pattern is desirable for most self defense and hunting applications.

In a related embodiment, one or more of the first shot and/or second shot may be other than perfectly spherical. For instance, they may be regular or irregular polyhedra. Irregular polyhedra may have one or more of the following features: differing angles where the faces meet each other to approximate the angles of the other pellets in the three dimensional array, rounded vertices, rounded edges, or concave faces. One example of such a shape may be produced by pressing lead spheres between steel balls of the same size which have been placed in a pentagonal stacked array. Such a shape would have the same mass as the other pellets, would fit exactly in the center space, and would have comparable penetration as the other pellets. Another example could use the same method, but starting with center regular dodecahedra of the same mass as the other pellets. Such a resulting pressed shape would retain corners and edges which would result in a greater wound channel. Furthermore, other non-spherical shots may also be within the scope of the present invention and may include ellipsoidal shot, cylindrical shot, regular cuboidal shot, irregular cuboidal shot, regular octahedral shot, irregular octahedral shot, regular dodecahedral shot, irregular dodecahedral shot, regular polyhedral shot, irregular polyhedral shot, or any combination thereof.

Embodiments having been described hereinabove, it will be apparent to those skilled in the art that the above methods and apparatuses may incorporate changes and modifications without departing from the general scope of this invention. The invention is intended to include all such modifications and alterations insofar as they come within the scope of the appended claims or the equivalents thereof.

I claim:

1. An improved cartridge ammunition load, comprising:
- a shot casing having a first end adapted to be retained in a breach and a second end adapted to face a muzzle;
- a combustible propellant charge disposed at the first end of the shot casing and defining a layer;
- a wad disposed in the shot casing and defining a barrier between the first end and the second end of the shot casing; and
- a plurality of shot contained within the second end of the shot casing and retained therein, the shot comprising:
  - five of a first shot having a first size, each of the first shots having centers of mass lying on a common plane and defining a pentagonal ring, wherein the five first shots collectively define a central interstice; and
  - a second shot having a second size which is less than that of the first shots and having a center of mass axially aligned with a collective center of mass of the pentagonal ring of first shots.

2. The cartridge of claim 1, wherein the first shots and second shot are individually selected from one or more of spherical shot, ellipsoidal shot, cylindrical shot, regular cuboidal shot, irregular cuboidal shot, regular octahedral shot, irregular octahedral shot, regular dodecahedral shot, irregular dodecahedral shot, regular polyhedral shot, irregular polyhedral shot, or any combination thereof.

3. The cartridge of claim 2, wherein the second shot defines a generally spherical shape having a diameter, as a percentage of the diameter of the first shot, from about 80% to 81%, 81% to 82%, 82% to 83%, 83% to 84%, 84% to 85%, 85% to 86%, 86% to 87%, 87% to 88%, 88% to 89%, 89% to 90%, 90% to 91%, 91% to 92%, 92% to 93%, 93% to 94%, 94% to 95% or any combination thereof.

4. The cartridge of claim 1, wherein each of the first shots and each of the second shots individually comprise a material selected from one or more of lead, iron, nickel, cobalt, steel, copper, bismuth, plated shot, tungsten, thorium, depleted uranium, hardened shot, rubber, rubber-coated metal, or any alloy or combination thereof.

5. The cartridge of claim 1, wherein the second shot comprises a material having a density as a percentage of that of the first shot which is from about 0 percent to 250 percent different from that of the first shot.

6. The cartridge of claim 1, wherein each of the first shots contacts two of the other first shots having centers of mass lying on a common plane.

7. The cartridge of claim 1, wherein a plurality of the first shot is arranged in a plurality of groups of five, wherein all shots in each group of five shots have centers of mass lying on a common plane and defining a pentagonal ring, and wherein each plane containing a pentagonal ring of five shots is oriented generally parallel to other planes containing five shots.

8. The cartridge of claim 7, wherein a second shot is interposed between one or more of the plurality of pentagonal rings of first shot and axially aligned with the collective centers of mass of each of the pentagonal rings of first shot.

9. The cartridge of claim 8, wherein a second shot is interposed between each of the plurality of pentagonal rings of first shot and axially aligned with the collective centers of mass of each of the pentagonal rings of first shot.

10. The cartridge of claim 7, wherein each of the plurality of parallel pentagonal rings of first shot are in a staggered orientation relative to the closest parallel pentagonal ring of first shot.

11. The cartridge of claim 10, wherein each of the plurality of parallel pentagonal rings of first shot contact the closest parallel ring of first shot.

12. The cartridge of claim 11, wherein a second shot is interposed between one or more of the plurality of pentagonal rings of first shot and axially aligned with the collective centers of mass of each of the pentagonal rings of first shot, and wherein each second shot contacts less than all of the immediately surrounding first shot.

13. The cartridge of claim 11, wherein a second shot is interposed between one or more of the plurality of pentagonal rings of first shot and axially aligned with the collective centers of mass of each of the pentagonal rings of first shot, and wherein each second shot contacts all of the immediately surrounding first shot.

14. An improved cartridge ammunition load, comprising:

a shot casing having a first end adapted to be retained in a breach and a second end adapted to face a muzzle;

a combustible propellant charge disposed at the first end of the shot casing and defining a layer;

a wad disposed in the shot casing and defining a barrier between the first end and the second end of the shot casing; and a plurality of shot contained within the second end of the shot casing and retained therein, the shot comprising:

a plurality of groups of five of a first shot, each of the first shot having a first size, and each group of five of the first shot having centers of mass lying on a common plane, and each group of five of the first shot defining a pentagonal ring, wherein each of the pentagonal rings are oriented generally parallel to the other pentagonal rings, and wherein each pentagonal ring defines a central interstice; and a second shot having a second size which is less than that of the first shots and having a center of mass axially aligned with a collective center of mass of each of the pentagonal rings of first shots and disposed within the central interstices of the pentagonal rings of first shot.

15. The cartridge of claim 14, wherein the second shot defines a generally spherical shape having a diameter, as a percentage of the diameter of the first shot, from about 80% to 81%, 81% to 82%, 82% to 83%, 83% to 84%, 84% to 85%, 85% to 86%, 86% to 87%, 87% to 88%, 88% to 89%, 89% to 90%, 90% to 91%, 91% to 92%, 92% to 93%, 93% to 94%, 94% to 95% or any combination thereof.

16. The cartridge of claim 14, wherein each of the first shots contacts two of the other first shots having centers of mass lying on a common plane.

17. The cartridge of claim 14, wherein each of the plurality of parallel pentagonal rings of first shot are in a staggered orientation relative to the closest parallel pentagonal ring of first shot.

18. The cartridge of claim 17, wherein each of the plurality of parallel pentagonal rings of first shot contact the closest parallel ring of first shot.

19. The cartridge of claim 14, wherein each second shot contacts less than all of the immediately surrounding first shot.

20. An improved cartridge ammunition load, comprising:

a shot casing having a first end adapted to be retained in a breach and a second end adapted to face a muzzle;

a combustible propellant charge disposed at the first end of the shot casing and defining a layer;

a wad disposed in the shot casing and defining a barrier between the first end and the second end of the shot casing; and a plurality of shot contained within the second end of the shot casing and retained therein, the shot comprising:

a plurality of groups of five of a first shot, each of the first shot having a first size, and each group of five of the first shot having centers of mass lying on a common plane, and each group of five of the first shot defining a pentagonal ring, wherein each of the pentagonal rings are oriented generally parallel to the other pentagonal rings, wherein each pentagonal ring defines a central interstice, wherein each of the first shots contacts two of the other first shots having centers of mass lying on a common plane, wherein each of the plurality of parallel pentagonal rings of first shot are in a staggered orientation relative to the closest parallel pentagonal ring of first shot, and wherein each of the plurality of parallel pentagonal rings of first shot contact the closest parallel ring of first shot; and a second shot having a second size which is less than that of the first shots and having a center of mass axially aligned with a collective center of mass of each of the pentagonal rings of first shots and disposed within the central interstices of the pentagonal rings of first shot, wherein the second shot defines a generally spherical shape having a diameter, as a percentage of the diameter of the first shot, from about 80% to 81%, 81% to 82%, 82% to 83%, 83% to 84%, 84% to 85%, 85% to 86%, 86% to 87%, 87% to 88%, 88% to 89%, 89% to 90%, 90% to 91%, 91% to 92%, 92% to 93%, 93% to 94%, 94% to 95% or any combination thereof, and wherein each second shot contacts less than all of the immediately surrounding first shot.

* * * * *